US008327648B2

(12) United States Patent
Phillips et al.

(10) Patent No.: US 8,327,648 B2
(45) Date of Patent: Dec. 11, 2012

(54) COMBUSTOR LINER WITH INTEGRATED ANTI-ROTATION AND REMOVAL FEATURE

(75) Inventors: Stephen Phillips, Toronto (CA); Kenneth Parkman, Georgetown (CA); Bhawan B. Patel, Mississauga (CA); Pierrot Duchesne, McMasterville (CA)

(73) Assignee: Pratt & Whitney Canada Corp., Longueuil (CA)

( * ) Notice: Subject to any disclaimer, the term of this patent is extended or adjusted under 35 U.S.C. 154(b) by 920 days.

(21) Appl. No.: 12/330,803

(22) Filed: Dec. 9, 2008

(65) Prior Publication Data

US 2010/0139283 A1 Jun. 10, 2010

(51) Int. Cl.
*F02C 1/00* (2006.01)

(52) U.S. Cl. ..... 60/798; 60/796; 60/797; 60/800; 60/752; 29/426.5; 29/426.6; 29/889.2

(58) Field of Classification Search ..... 60/261, 60/737, 746, 747, 752, 796, 797, 798, 804, 60/799, 800; 29/426.1, 426.5, 426.6, 525, 29/889.2, 889.21, 889.22
See application file for complete search history.

(56) References Cited

U.S. PATENT DOCUMENTS

| | | | | |
|---|---|---|---|---|
| 202,457 | A | 4/1878 | Oliver | |
| 2,459,221 | A | 1/1949 | Farrington | |
| 3,152,557 | A | 5/1964 | Bauer | |
| 3,589,127 | A | 6/1971 | Kenworthy et al. | |
| 4,034,837 | A | 7/1977 | Vinarcsik et al. | |
| 4,319,790 | A | 3/1982 | Thomson | |
| 4,549,402 | A * | 10/1985 | Saintsbury et al. | 60/738 |
| 5,222,358 | A | 6/1993 | Chaput et al. | |
| 5,704,208 | A * | 1/1998 | Brewer et al. | 60/766 |
| 6,331,110 | B1 | 12/2001 | Steber et al. | |
| 6,499,993 | B2 | 12/2002 | Steber et al. | |
| 6,537,022 | B1 | 3/2003 | Housley et al. | |
| 6,655,147 | B2 * | 12/2003 | Farmer et al. | 60/752 |
| 6,880,218 | B2 * | 4/2005 | Christopher | 29/239 |
| 6,976,363 | B2 | 12/2005 | McMasters et al. | |
| 2006/0288707 | A1 | 12/2006 | Weaver et al. | |
| 2007/0084215 | A1 | 4/2007 | Hernandez et al. | |
| 2007/0119181 | A1 | 5/2007 | Lohmueller et al. | |
| 2007/0193273 | A1 | 8/2007 | DeVane et al. | |
| 2008/0069688 | A1 * | 3/2008 | Harper et al. | 415/196 |

* cited by examiner

*Primary Examiner* — Ehud Gartenberg
*Assistant Examiner* — Steven Sutherland
(74) *Attorney, Agent, or Firm* — Norton Rose Canada LLP

(57) ABSTRACT

A combustor liner for a gas turbine engine including first and second annular liner portions engaged to one another with an interference fit. The first liner portion includes at least one anti-rotation feature extending therefrom and engaging the second liner portion and having a threaded hole defined therethrough at least substantially perpendicularly to an adjacent radially extending surface of the second liner portion for threadingly receiving a pushing tool for pushing against that surface.

17 Claims, 3 Drawing Sheets

COMBUSTOR LINER WITH INTEGRATED ANTI-ROTATION AND REMOVAL FEATURE

TECHNICAL FIELD

The application relates generally to combustors of gas turbine engines and, more particularly, to anti-rotation features for liners of such combustors.

BACKGROUND

Combustor liners typically include anti-rotation features, such as tab and slot arrangements, to maintain the inner and outer liners in circumferential alignment with one another, thereby ensuring proper aerodynamic function of the combustor.

In cases where the inner and outer liners of the combustor are retained to one another through an interference fit, it is known to provide a separate removal feature, such as a threaded insert or a circumferential puller groove to receive a tool, for forcing the two liner portions apart for maintenance or repair. However, the addition of a puller groove on one of the liners necessitates additional material, thus increasing the weight of the combustor, while inserts require additional installation time and can loosen during engine operation, thus requiring re-installation during an engine overhaul.

SUMMARY

In one aspect, there is provided a combustor liner for a gas turbine engine, the liner comprising first and second annular liner portions engaged to one another with an interference fit to define a combustion chamber, the first liner portion including at least one anti-rotation feature extending therefrom and engaging the second liner portion to prevent relative rotation between the first and second annular liner portions, at least one of the at least one anti-rotation feature having a threaded hole defined therethrough at least substantially perpendicularly to an adjacent radially extending surface of the second liner portion for threadingly receiving a pushing tool for pushing against the radially extending surface.

In another aspect, there is provided a gas turbine engine comprising annular inner and outer members interconnected through an interference fit, one of the inner and outer members including at least one anti-rotation feature extending therefrom and engaging the other of the inner and outer members to prevent relative rotation therebetween, the at least one anti-rotation feature including a threaded hole defined at least substantially axially therethrough, the other of the inner and outer members including a surface extending at least substantially radially and adjacent the threaded hole such as to be pushed by a tool threadingly received in the threaded hole in order to separate the inner and outer members.

In another aspect, there is provided a method of manufacturing a combustor liner, comprising forming a first annular liner portion with a plurality of anti-rotation features extending therefrom, providing an axially extending threaded hole in at least some of the anti-rotation features, forming a second annular liner portion with a plurality of slots sized and positioned to each receive one of the anti-rotation features therein, and assembling the first and second liner portions with an interference fit therebetween and with each anti-rotation feature received in a respective one of the slots.

In a further aspect, there is provided a method of detaching inner and outer liners of a combustor liner interconnected through an interference fit, comprising inserting a threaded tool in a threaded hole of at least one anti-rotation feature integral with one of the inner and outer liners and engaged to the other of the inner and outer liners to prevent relative rotation therebetween, and rotating the threaded tool to advance the tool into contact with a surface of the other of the inner and outer liners to produce a force separating the anti-rotation feature and the surface until the interference fit is overcome and the inner and outer liners are detached from one another.

DESCRIPTION OF THE DRAWINGS

Reference is now made to the accompanying figures in which.

DETAILED DESCRIPTION

Figure 1:
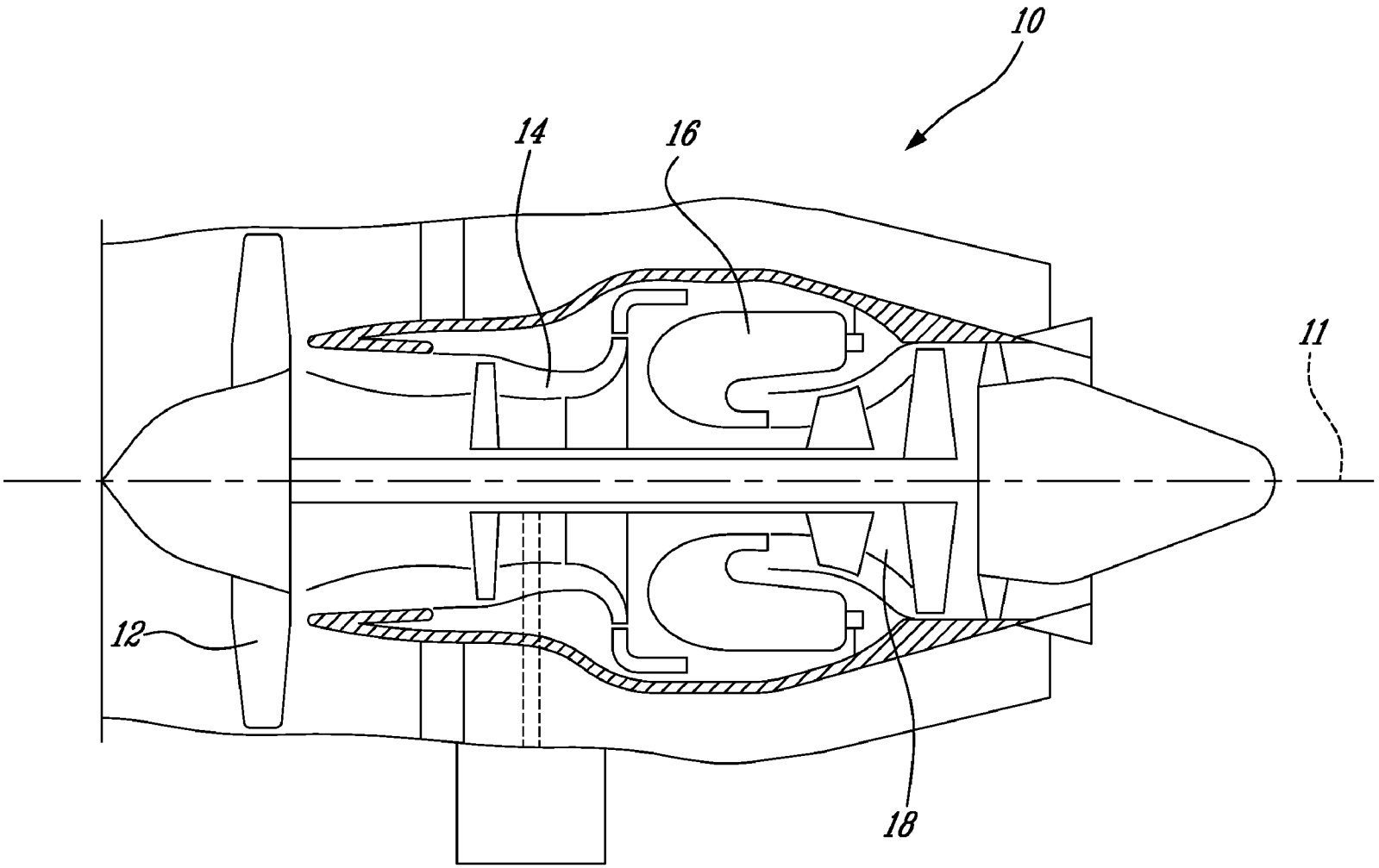
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases.

In the present specification and claims, the teens "circumferential", "radial" and "axial", and all related terms, refer to directions with respect to a central axis 11 of the gas turbine engine 10.

Figure 2:
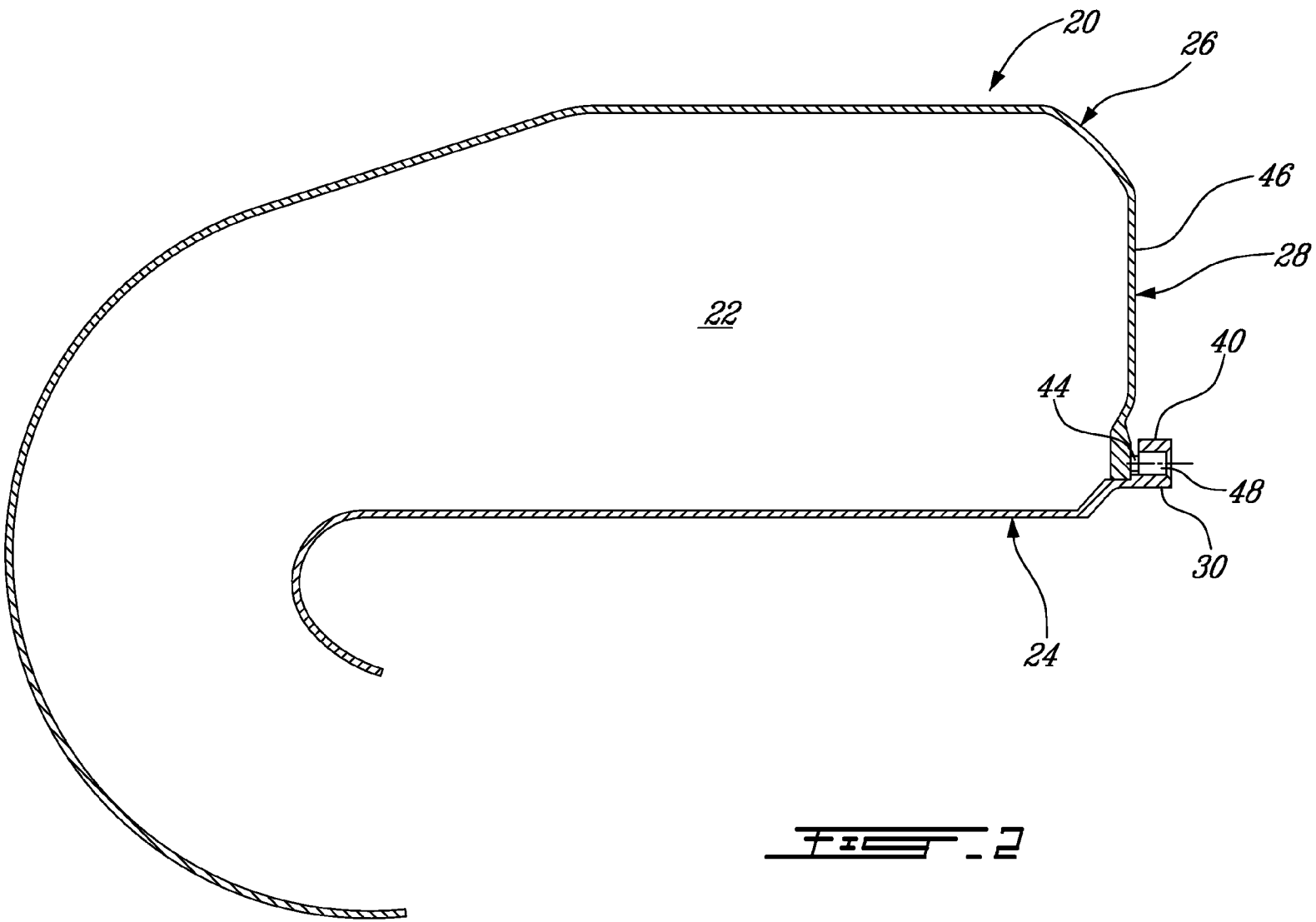
FIG. 2 is a schematic cross-sectional view of a combustor liner which can be used in a gas turbine engine such as shown in FIG. 1.

Referring to FIG. 2, the combustor 16 comprises a combustor liner 20 defining a combustion chamber 22 where the compressed air is mixed with fuel and ignited. The combustor liner 20 includes two annular members or liner portions, the inner liner 24 and the outer liner 26, which are interconnected at their upstream end at or in proximity of a dome end 28 of the combustor liner 20. Each liner portion 24, 26 includes a circumferential flange 30, 32 (see FIG. 3), and the flanges 30, 32 are engaged to one another with an interference fit such as to interconnect the liner portions 24, 26.

Figure 3:
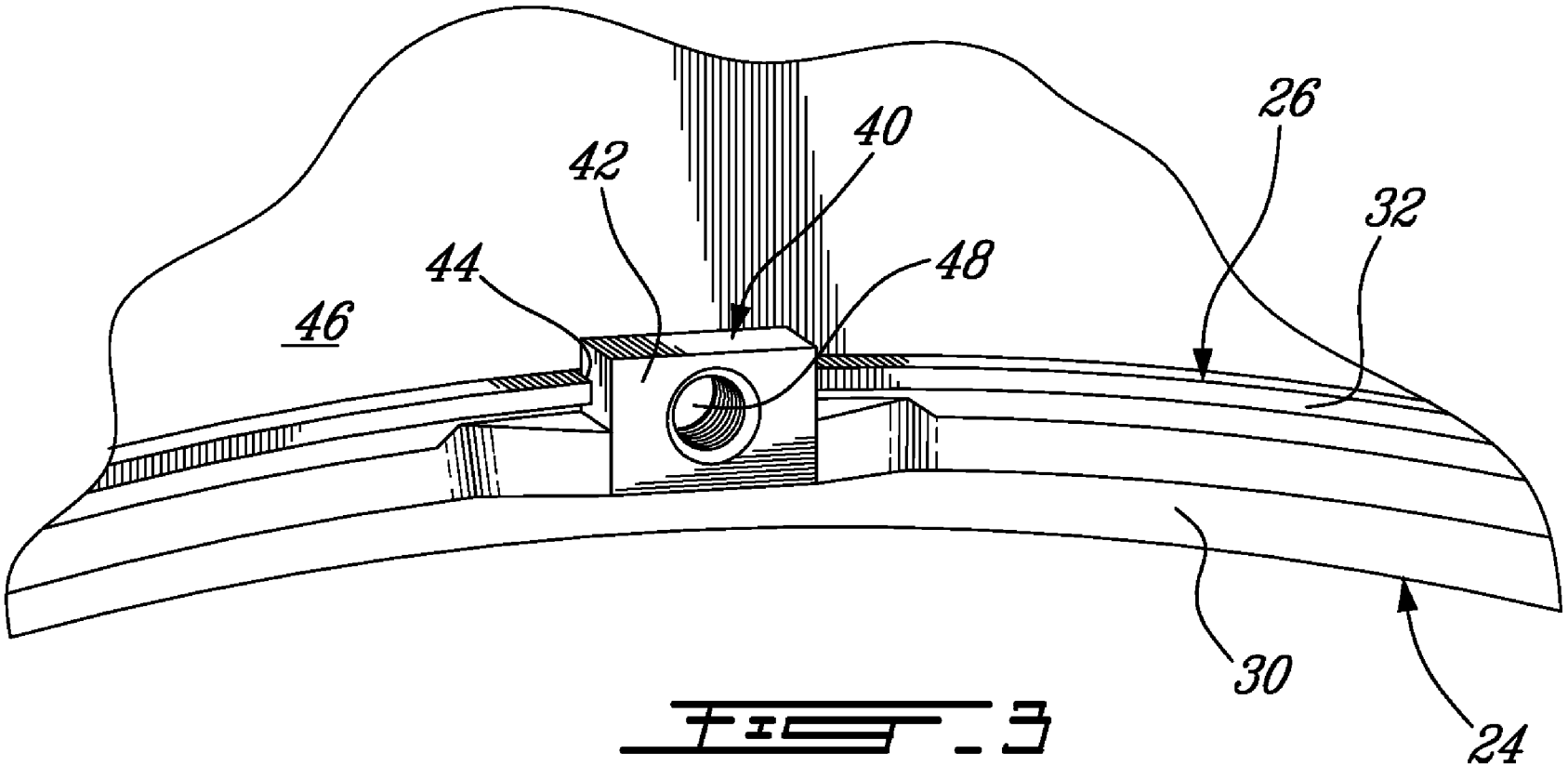
FIG. 3 is a schematic perspective view of an anti-rotation feature also acting as a removal feature, which can be integrated in a combustor liner such as shown in FIG. 2.

Referring to FIG. 3, the inner liner 24 includes at least one anti-rotation feature 40. In the embodiment shown, the anti-rotation feature 40 includes a finger 42 extending radially from the flange 30 of the inner liner 24. The finger 42 is received in a corresponding slot 44 defined in the flange 32 of the outer liner 26, the slot 44 having a width slightly larger than that of the finger 42. The finger 42 engaged in the slot 44 thus prevents relative rotation between the two liner portions 24, 26. In the embodiment shown the finger 42 has a rectangular shape, although any other adequate shape can alternately be used.

In a particular embodiment the finger 42 is an integral part of the inner liner 24, i.e. the finger 42 is integrally machined in the inner liner 24. However, the finger 42 can alternately be separately formed (such as by casting, machining, etc.) and then fastened in place (such as by welding, etc.) onto the flange 30.

Referring back to FIG. 2, the finger 42 extends adjacent an at least substantially radially extending surface 46 of the outer liner, which in the embodiment shown defines the dome end 28 of the combustor liner 20. The finger 42 includes a threaded hole 48 defined therethrough, oriented such as to extend at least substantially axially with respect to the axis of the combustor liner 20 or the engine axis 11 (see FIG. 1), i.e. at least substantially perpendicularly to the radial surface 46 of the outer liner 26. As such, when the two liner portions 24, 26 need to be detached from one another, for example for maintenance or repair, a threaded pushing tool such as a bolt (not shown) is threadingly engaged in the hole 48 until the tool rests against the radial surface 46 of the outer liner 26 and produces a pushing force against that radial surface 46 until the interference fit between the two circumferential flanges 30, 32 is overcome.

The anti-rotation feature 40 is thus an integrated, dual-purpose device, which acts as a removal feature for disassembly of the two liner portions 24, 26 while nonetheless acting as an anti-rotation feature to ensure circumferential alignment of the two liner portions.

The number of features 40 is selected according to the strength of the interference fit to be overcome for detachment of the liner portions 24, 26 from one another. In a particular embodiment, seven (7) features 40 are provided and are preferably, although not necessarily, regularly spaced apart about the circumference of the combustor liner 20.

In another particular embodiment, only a single feature 40 is provided in the inner liner 24. However, more features (ex: two, three, etc.) can also be used. In fact, in another alternate embodiment, three such features 40 are provided and equally circumferentially spaced about the combustor liner.

In a particular embodiment, all the anti-rotation features 40 are also configured as removal features. In an alternate embodiment, only some of the number of anti-rotation features 40 are provided with the threaded hole 48 to act as anti-removal features.

Although the finger 42 has been shown as extending from the flange 30 of the inner liner and received in the slot 44 of the flange 32 of the outer liner 26, the finger 42 can alternately extend from another appropriate part of the inner liner 24 and/or be received in a respective slot formed in another appropriate part of the outer liner 26.

In another alternate embodiment (not shown) and when the geometry of the combustor liner 20 is adapted for such a configuration, the anti-rotation features 40, for example the fingers 42, extend from the outer liner 26 and are received in slots of the inner liner 24 to prevent relative rotation between the liner portions 24, 26, with some or all of the fingers 42 acting as a removal feature to receive a tool acting against a surface of the inner liner 24, for example by including the threaded hole 48 in some or all of the fingers 42.

The above description is meant to be exemplary only, and one skilled in the art will recognize that changes may be made to the embodiments described without departing from the scope of the invention disclosed. For example, although the combustor 16 shown herein is a reverse flow combustor, the anti-rotation feature 40 also acting as a removal feature described herein can be integrated in other types of combustor. Also, the features 40 can be used in other types of interconnecting annular members of the gas turbine engine 10 which are retained to one another with an interference fit and for which circumferential alignment should be ensured. Other modifications which fall within the scope of the present invention will be apparent to those skilled in the art, in light of a review of this disclosure, and such modifications are intended to fall within the appended claims.

The invention claimed is:

1. A combustor liner for a gas turbine engine, the liner comprising first and second annular liner portions engaged to one another with an interference fit to define a combustion chamber, the first liner portion including at least one anti-rotation feature extending therefrom and engaging the second liner portion to prevent relative rotation between the first and second annular liner portions, at least one of the at least one anti-rotation feature having a threaded hole defined therethrough independently of the engagement between the anti-rotation feature and the second liner portion and extending substantially perpendicularly to an adjacent radially extending surface of the second liner portion for threadingly receiving a pushing tool for pushing against the radially extending surface.

2. The combustor liner as defined in claim 1, wherein the first and second annular liner portions respectively include first and second annular circumferential flanges engaged to one another with the interference fit, each of the at least one anti-rotation feature including a finger extending from the first flange and engaged in a respective slot defined in the second flange.

3. The combustor liner as defined in claim 1, wherein the at least one anti-rotation feature includes a plurality of anti-rotation features regularly spaced apart around a circumference of the combustor liner.

4. The combustor liner as defined in claim 1, wherein the first liner portion is an inner liner and the second liner portion is an outer liner.

5. The combustor liner as defined in claim 1, wherein all of the at least one anti-rotation feature have the threaded hole defined therethrough.

6. The combustor liner as defined hn claim 1, wherein the at least one anti-rotation feature is an integral part of the first liner.

7. A gas turbine engine comprising annular inner and outer members interconnected through an interference fit, one of the inner and outer members including at least one anti-rotation feature extending therefrom and engaging the other of the inner and outer members to prevent relative rotation therebetween, the at least one anti-rotation feature including a threaded hole defined substantially axially therethrough independently of the engagement between the anti-rotation feature and the other of the inner and outer members, the other of the inner and outer members including a surface extending at least substantially radially and adjacent the threaded hole such as to be pushed by a tool threadingly received in the threaded hole in order to separate the inner and outer members.

8. The gas turbine engine as defined in claim 7, wherein the gas turbine engine has a combustion section including a combustor, the inner member being an inner liner of the combustor and the outer member being an outer liner of the combustor, the inner and outer liners being interconnected through the interference fit one of at and adjacent a dome end of the combustor.

9. The gas turbine engine as defined in claim 7, wherein the inner and outer members respectively include annular circumferential flanges engaged to one another with the interference fit, each of the at least one anti-rotation feature including a finger extending from the flange of the one of the inner and outer members and engaged in a respective slot defined in the flange of the other of the inner and outer members.

10. The gas turbine engine as defined in claim 7, wherein the at least one anti-rotation feature includes a plurality of anti-rotation features regularly spaced apart around a circumference of the one of the inner and outer members.

11. The gas turbine engine as defined in claim 7, wherein the inner member includes the at least one anti-rotation feature extending therefrom.

12. The gas turbine engine as defined in claim 7, wherein the at least one anti-rotation feature is an integral part of the one of the inner and outer members.

13. A method of manufacturing a combustor liner, comprising forming a first annular liner portion with a plurality of anti-rotation features extending therefrom, providing an axially extending threaded hole in at least some of the anti-rotation features, forming a second annular liner portion with a plurality of slots sized and positioned to each receive one of the anti-rotation features therein, and assembling the first and second liner portions with an interference fit therebetween and with each anti-rotation feature received in a respective one of the slots, the first and second liner portions being engaged independently of the threaded hole in each one of the at least some of the anti-rotation features.

14. The method as defined in claim 13, wherein forming the first annular liner portion includes forming the plurality of anti-rotation features integrally with the first annular liner portion.

15. The method as defined in claim 13, wherein forming the first annular liner portion includes forming the anti-rotation features such that the anti-rotation features are regularly spaced apart about a circumference of the first annular liner portion.

16. The method as defined in claim 13, wherein providing the axially extending threaded hole in at least some of the anti-rotation features includes providing the axially extending threaded hole in all of the anti-rotation features.

17. A method of detaching inner and outer liners of a combustor liner interconnected through an interference fit, comprising inserting a threaded tool in a threaded hole of at least one anti-rotation feature integral with one of the inner and outer liners and engaged to the other of the inner and outer liners independently of the threaded hole to prevent relative rotation therebetween, and rotating the threaded tool to advance the tool into contact with a surface of the other of the inner and outer liners to produce a force separating the anti-rotation feature and the surface until the interference fit is overcome and the inner and outer liners are detached from one another.

* * * * *